US011136674B2

(12) United States Patent
Ding et al.

(10) Patent No.: US 11,136,674 B2
(45) Date of Patent: Oct. 5, 2021

(54) TURBINE BLADE INTERNAL HOT CORROSION OXIDE CLEANING

(71) Applicant: United Technologies Corporation, Farmington, CT (US)

(72) Inventors: Zhongfen Ding, South Windsor, CT (US); William J. Brindley, Hebron, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/229,526

(22) Filed: Dec. 21, 2018

(65) Prior Publication Data

US 2020/0199763 A1 Jun. 25, 2020

(51) Int. Cl.

| | |
|---|---|
| ***B08B 7/00*** | (2006.01) |
| ***C23F 1/16*** | (2006.01) |
| ***C23F 1/44*** | (2006.01) |
| ***C23G 5/00*** | (2006.01) |
| ***F01D 25/00*** | (2006.01) |
| ***F01D 5/00*** | (2006.01) |
| ***F01D 5/28*** | (2006.01) |

(52) U.S. Cl.

CPC ..... *C23F 1/44* (2013.01); *B08B 7/0021* (2013.01); *C23F 1/16* (2013.01); *C23G 5/00* (2013.01); *F01D 5/005* (2013.01); *F01D 25/002* (2013.01); *F01D 5/288* (2013.01); *F05D 2230/80* (2013.01); *F05D 2230/90* (2013.01); *F05D 2300/611* (2013.01)

(58) Field of Classification Search

None

See application file for complete search history.

(56) References Cited

U.S. PATENT DOCUMENTS

| | | | | |
|---|---|---|---|---|
| 4,317,685 | A | 3/1982 | Ahuja et al. | |
| 5,643,474 | A | 7/1997 | Sangeeta | |
| 5,685,917 | A | 11/1997 | Sangeeta | |
| 5,688,755 | A * | 11/1997 | Ikeda | C23G 1/125 134/3 |
| 5,779,809 | A | 7/1998 | Sangeeta | |
| 6,099,655 | A | 8/2000 | Farr | |
| 2004/0072706 | A1 * | 4/2004 | Arena-Foster | B08B 7/00 510/175 |
| 2006/0102204 | A1 | 5/2006 | Jacobson | |
| 2007/0125459 | A1 | 6/2007 | Gupta et al. | |
| 2017/0356092 | A1 | 12/2017 | Ding et al. | |

OTHER PUBLICATIONS

EP search report for EP19220267.9 dated May 19, 2020.

* cited by examiner

*Primary Examiner* — Stephanie P Duclair

(74) *Attorney, Agent, or Firm* — Getz Balich LLC

(57) ABSTRACT

A material removal method comprises receiving a component that includes a component body and a coating on the component body, the component body comprising metallic first material, and the coating comprising a second material that is different from the first material, wherein the component is a component of an item of rotational equipment. The method also includes receiving a solution comprising nitric acid and hydrogen peroxide and subjecting at least a portion of the coating to the solution in supercritical condition in order to remove at least some of the second material from the component, wherein a chemistry of the solution is selected such that the solution is substantially non-reactive with the first material.

20 Claims, 3 Drawing Sheets

TURBINE BLADE INTERNAL HOT CORROSION OXIDE CLEANING

BACKGROUND OF THE INVENTION

1. Technical Field

The present disclosure relates generally to a method for chemically removing material coating a component using a supercritical/near critical solution.

2. Background Information

A typical nickel super alloy with a single crystal microstructure has a high temperature strength, toughness and resistance to corrosive and/or oxidative environment. Such an alloy therefore may be used to construct components, for example turbine blades, that are subject to hot and corrosive environments during use. However, forming a component from a nickel super alloy with a single crystal microstructure is time consuming and expensive. There is a need in the art therefore for methods to refurbish such a component and thereby extend its service life after that component has been exposed to a hot and corrosive environment.

U.S. Patent Application Publication No. 2017/0356092, assigned to the assignee of the present invention, discloses removing material with nitric acid and hydrogen peroxide solution. The assignee of the present application has found that this method is relatively slow in the context of a manufacturing and overhaul of turbine blades. For example, it may take 4-24 hours to remove hot corrosion products depending upon the thickness and density of the hot corrosion products. There is a need for a more efficient hot corrosion product removal process.

SUMMARY OF THE DISCLOSURE

The following presents a simplified summary in order to provide a basic understanding of some aspects of the disclosure. The summary is not an extensive overview of the disclosure. It is neither intended to identify key or critical elements of the disclosure nor delineate the scope of the disclosure. The following summary merely presents some concepts of the disclosure in a simplified form as a prelude to the description below.

Aspects of the disclosure are directed to a material removal method that comprises receiving a component that includes a component body and a coating on the component body, the component body comprising metallic first material, and the coating comprising a second material that is different from the first material, wherein the component is a component of an item of rotational equipment. The method also includes receiving a solution comprising nitric acid and hydrogen peroxide and subjecting at least a portion of the coating to the solution in supercritical condition in order to remove at least some of the second material from the component, wherein a chemistry of the solution is selected such that the solution is substantially non-reactive with the first material.

The solution may comprise between about 1 to 40 percent by volume of the nitric acid.

The solution may comprise between about 1 to 25 percent by volume of the hydrogen peroxide.

The solution may comprise one or more complexing agents.

The one or more complexing agents may comprise at least one of ammonia, organic amine, organic acids, inorganic acids, and/or halide.

The second material may comprise a byproduct of corrosion of the first material.

Aspects of the disclosure are also directed to a material removal method that comprises receiving a component that includes a component body and a coating on the component body, the component body comprising metallic first material, and the coating comprising second material that is different from the first material, wherein the component is a component of a gas turbine engine. The method also includes receiving a solution comprising nitric acid and hydrogen peroxide and subjecting, within an autoclave, at least a portion of the coating to the solution in supercritical condition in order to remove at least some of the second material from the component, wherein the second material comprises scales of nitride, oxides, salt and/or sulfide.

The first material may comprise a nickel alloy.

The first material may comprise a cobalt alloy.

The first material may comprise a single crystal microstructure.

The method may further comprise maintaining the solution at a temperature between about 30 to 90 degrees Celsius during the subjecting of at least a portion of the coating to the solution in supercritical condition.

At least a portion of the coating may be subjected to the solution in supercritical condition for a time period between about 0.5 to 4 hours.

At least a portion of the coating may be at an internal surface of the component.

The item of rotational equipment may comprise a gas turbine engine, and the component comprises an airfoil.

Aspects of the disclosure are further directed to a material removal method that comprises receiving a component of a gas turbine engine, the component includes a component body and a coating on the component body, the component body comprises a nickel and/or cobalt alloy, and the coating comprises material that is a byproduct of corrosion of the component body. The method also includes receiving a solution comprising nitric acid and hydrogen peroxide, and within an autoclave subjecting the coating at a location on the component body to the solution in supercritical condition in order to remove all of the material at the location on the component body from the component by dissolving the material at the location on the component body with the solution in a steady digestive process.

The component may comprise an airfoil for the turbine engine.

The solution may comprise between about 1 to 40 percent by volume of the nitric acid and between about 1 to 25 percent by volume of the hydrogen peroxide.

The method may further comprise maintaining the solution at a temperature between about 30 to 90 degrees Celsius and a pressure of about 80 to 200 atm during the subjecting of coating at the location on the component body to the solution in supercritical condition, wherein the coating at the location on the component body is subjected to the solution in supercritical condition for a time period between about 0.5 to 4 hours.

The method may further comprise maintaining the solution at a temperature between about 50 to 90 degrees Celsius and pressure of about 80 to 100 atm during the subjecting of the coating at the location on the component body to the solution in supercritical condition, wherein the coating at the location on the component body is subjected to the solution in supercritical condition for a time period between about 0.5 to 4 hours.

The item of rotational equipment may be a gas turbine engine.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Methods are provided for removing material coated on a component. This component may be configured for an item of rotational equipment. The component, for example, may be configured as or include an airfoil. Examples of such a component include, but are not limited to, a turbine blade, a vane and a propeller. In another example, the component may be configured as a panel or other component of a gas path wall. The methods of the present disclosure, however, are not limited to the foregoing exemplary component configurations.

The item of rotational equipment may be a gas turbine engine. The gas turbine engine may be configured in an aircraft propulsion system. Alternatively, the gas turbine engine may be configured in an auxiliary power unit for the aircraft. The methods of the present disclosure, however, are not limited to such aircraft applications. In other embodiments, for example, the gas turbine engine may be configured as an industrial gas turbine engine in a power generation system. In still other embodiments, the item of rotational equipment may alternatively be configured as a wind turbine, a water turbine or any other item of rotational equipment which includes a component capable of being treated as described below.

Figure 1:
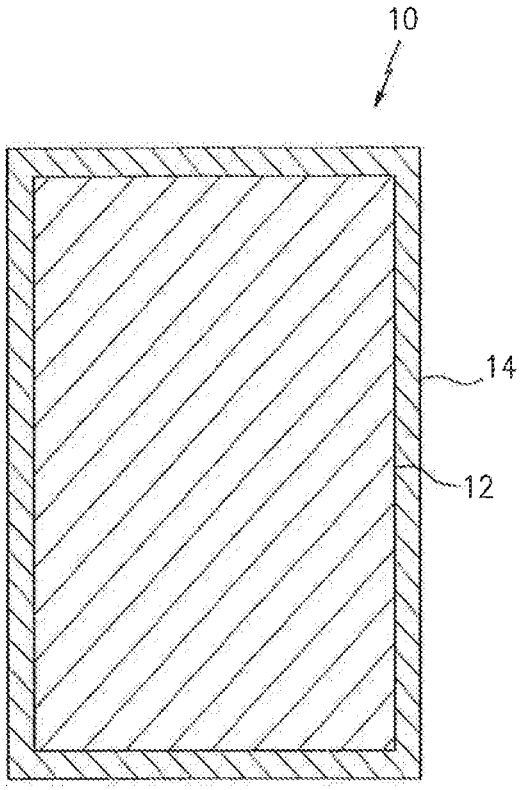
FIG. 1 is a schematic illustration of a component.

FIG. 1 is a block diagram illustration of a component 10 as described above. This component 10 includes a component body 12 (e.g., an airfoil body) and material 14 coated on the component body 12, which material is referred to below as "coating material".

The component body 12 of FIG. 1 is configured as a base of the component 10, and provides the component 10 with its structure and general geometry. The component body 12 is constructed (e.g., forged, cast, machined, additive manufactured, etc.) from metal. Examples of such metal include, but are not limited to, nickel (Ni), cobalt (Co), aluminum (Al), titanium (Ti) or an alloy of one or more of the foregoing materials. The component body 12, for example, may be formed from a nickel super alloy such as PWA1429 or PWA1440, which are tradenames of United Technologies Corporation of Farmington, Conn. In some embodiments, the component body 12 may be formed (e.g., cast and then cooled) such that the metal has a single crystal microstructure. The term "single crystal" may refer to a microstructure with a pattern of single crystal dendrites, where substantially all of the dendrites are solidified in a common crystallographic orientation. However, the present disclosure is not limited to any particular microstructures.

The coating material 14 may coat a portion or substantially all of the component body 12. The coating material 14 may be a byproduct of corrosion of the component body 12. For example, where the component 10 is an airfoil such as a turbine blade, the component body 12 may be subject to hot corrosion from deposition of environmental salts thereon during operation of the turbine engine. Such a hot corrosion process may subject the metal (e.g., Ni super alloy) of the component body 12 to repeated sulfidation, oxidation, nitridation, diffusion and/or other reactions. As a result of these reactions, layered oxide, nitride, salt and/or sulfide scales may be formed on the surface of the component body 12, and may make up the coating material 14. The coating material 14 of the present disclosure, however, is not limited to the foregoing exemplary coating materials or formation processes.

Figure 2:
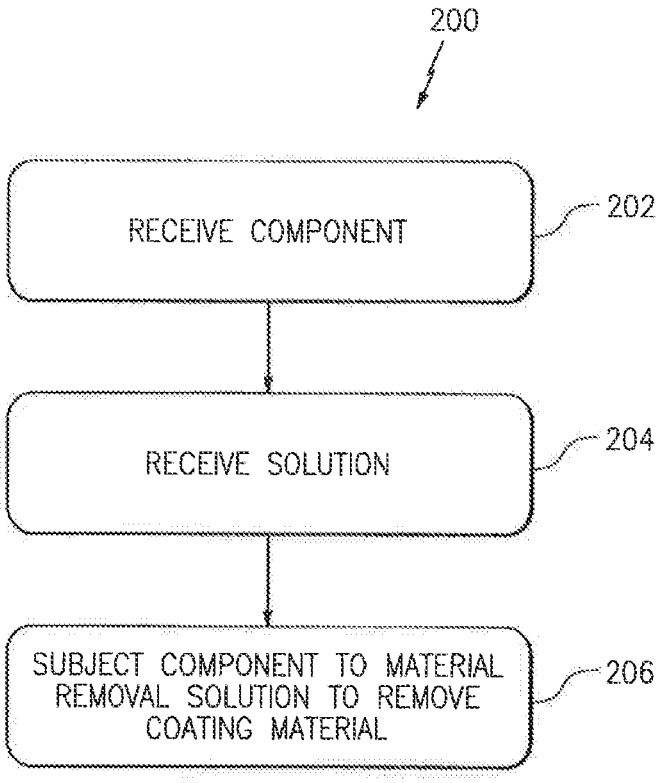
FIG. 2 is a flow diagram of a method for removing at least a portion of material coated on the component body of the component.

FIG. 2 is a flow diagram of a method 200 for removing at least a portion (or all) of the material coated on the component body 12. This method 200 is performed using a material removal solution 16.

The solution 16 includes a mixture that is supercritical (SC) or near critical (NC) fluid. In some embodiment the solution 16 may be a combination of water ($H_2O$), nitric acid ($HNO_3$), hydrogen peroxide $H_2O_2$ dissolved in carbon dioxide ($CO_2$). Supercritical or near critical fluid can penetrate dense internal oxide scales easier and let the particles flow out with the fluid. For example, supercritical or near critical fluid for internal oxide cleaning may include, for example, about 20 to 50 percent by volume of water, about 1 to 40 percent by volume of nitric acid and between about 1 to 25 percent by volume of hydrogen peroxide, which are mixed in an autoclave or pressure vessel that also contains the component 10. The autoclave or pressure vessel is preferably lined with Teflon to avoid corrosion of the vessel itself. The mixing may occur in an atmosphere of supercritical $CO_2$. The solution 16 may also include one or more other chemical components such as one or more complexing agents. Examples of complexing agents include, but are not limited to, ammonia, organic amine, organic acid, inorganic acid, and/or halide. In general, the chemical components of the solution 16 are selected and apportioned such that the solution 16 can remove the coating material 14 from the component body 12 without reacting with, removing or otherwise damaging the base material (e.g., metal) of the component body 12. The chemical components may also be selected to avoid carcinogenic chemicals, REACH chemicals, toxic chemicals such as, but not limited to, regulated hexavalent chromium and boron oxide compounds, etc. Exemplary solution 16 mixtures are listed below in Table 1. The present disclosure, however, is not limited to these exemplary mixtures.

TABLE 1

SOLUTION EXAMPLES

| | NITRIC ACID VOL % | HYDROGEN PEROXIDE VOL % | WATER VOL % |
|---|---|---|---|
| Example 1 | 20 | 20 | 60 |
| Example 2 | 15 | 15 | 70 |
| Example 3 | 20 | 15 | 65 |
| Example 4 | 15 | 20 | 65 |
| Example 5 | 15 | 10 | 75 |
| Example 6 | 10 | 20 | 70 |

As an example, solution 16 is made by mixing 20 percent by volume (20 vol %) of nitric acid, 20 percent by volume (20 vol %) of hydrogen peroxide, with 60 percent by volume (60 vol %) of water, and then bringing the mixture to supercritical conditions in an atmosphere of $CO_2$. Another example solution 16 is made by mixing 15 percent by volume (15 vol %) of nitric acid, 15 percent by volume (15 vol %) of hydrogen peroxide, 70 percent by volume (70 vol %) of water, and then bringing the mixture to supercritical conditions in an atmosphere of $CO_2$. Yet another example solution 16 may be made by mixing 20 percent by volume (20 vol %) of nitric acid, 15 percent by volume (15 vol %) of hydrogen peroxide, 65 percent by volume (65 vol %) of water, and then bringing the mixture to supercritical conditions in an atmosphere of $CO_2$.

Referring to FIG. 2, in step 202, the component 10 is received in an autoclave or pressure vessel. A component such as an airfoil, for example, may be received after that airfoil is removed from a gas turbine engine during maintenance or an overhaul.

In step 204, the solution 16 is received in the autoclave or pressure vessel. The solution 16, for example, may be prepared offsite and then received. Alternatively, one or more components for the solution 16 may be received on site, and then the solution 16 may be prepared on site. This preparation may occur before performance of the method 200, or during this step 204.

Figure 3:
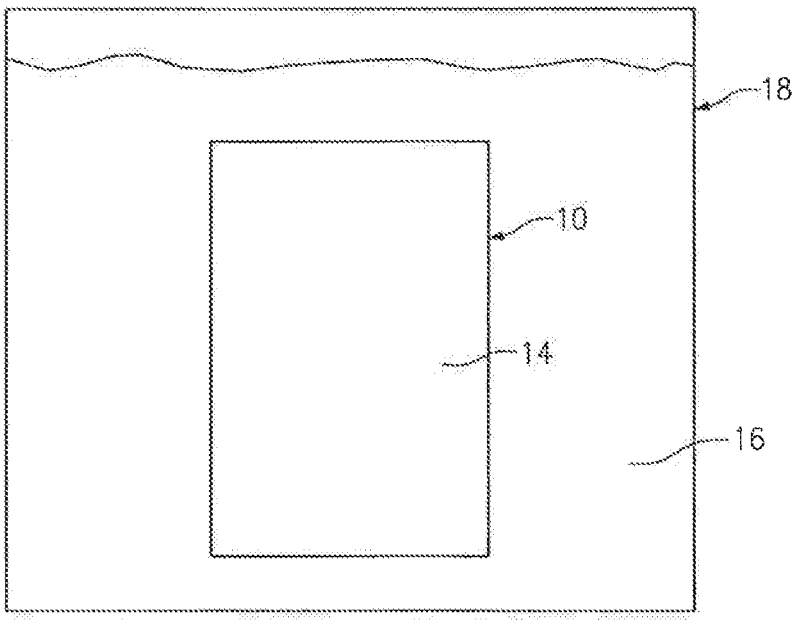
FIG. 3 is a schematic illustration of the component within a reservoir of a material removal solution all within an autoclave.

In step 206, the autoclave or pressure vessel is brought up to the desired internal pressure and temperature in order to establish the desired supercritical or near critical conditions for the solution. At least a portion of the coating is subjected to the solution 16 in order to remove at least some (or substantially all) of the coating material 14 from the component 10. For example, the component 10 may be disposed (e.g., submersed or otherwise immersed) within a reservoir/bath 18 of the solution 16 as shown in FIG. 3, where the solution 16 dissolves the coating material 14 in a steady digestive process.

During the step 206, the solution 16 may be maintained at the desired supercritical or near critical conditions for a period of between about 0.5 to 4 hours. Table 2 lists supercritical temperature and pressure conditions for possible components for the solution 16.

| | $T_C$ (deg C.) | $P_C$ (atm) |
|---|---|---|
| $CO_2$ | 31.1 | 73 |
| $H_2O$ | 374 | 218 |
| EtOH | 243 | 63 |
| Acetic Acid | 320 | 57 |

The method 200 of the present disclosure, however, is not limited to the foregoing exemplary treatment period. In particular, the treatment period may be altered depending on various parameters. Such parameters may include, but are not limited to, a thickness of the coating material 14 to be removed, a specific composition of the coating material 14, an allotted time period to remove the coating material 14, a composition of material beneath the coating material 14, etc.

In some embodiments, the component 10 may be fully immersed within the solution 16. In other embodiments, the component 10 may be partially immersed within the solution 16. In both of these embodiments, the solution 16 may be allowed to contact substantially all surfaces of the component 10, which may include internal and/or external surfaces. Alternatively, certain portion(s) of the component 10 may be masked or otherwise covered/blocked. In still other embodiments, rather than or in addition to immersing the component 10 within the solution 16, the solution 16 may be directed through/allowed to access one or more internal pathways (e.g., passages, cavities, etc.) within the component 10. The solution 16, for example, may be agitated to pass through cooling pathways of an airfoil to remove the coating material 14 from those internal cooling pathways. In such embodiments, the solution 16 may be directed once through or alternatively re-circulated through the internal pathways using a magnetically coupled impeller to induce fluid flow. The solution 16 once through the internal pathways exposes the coating material 14 to substantially pure solution, whereas recirculating the solution 16 through the internal pathways may expose the coating material 14 to a mixture of solution 16 and dissolved coating material 14 and/or other debris.

In some embodiments, the component body 12 may include one or more coating layers between the coating material 14 and the base material (e.g., metal) of the component body 12. For example, the base material may be coated with protective coating(s) such as, but not limited to, thermal barrier coating, hard coatings, environmental coating, etc. In such embodiments, the coating material 14 may accumulate on these other coating(s). The method 200 may also be performed to remove the coating material 14 in such embodiments.

In some embodiments, the method 200 may include one or more additional processing steps. For example, the component 10 may be treated with another solution before the coating removal described above. In another example, a top layer or bottom layer of the coating material 14 may be removed using another process; e.g., media blasting or otherwise. In still another example, after the coating material 14 is removed, the underlying component material may be coated with another material such as, but not limited to, a protective coating as described above.

It is contemplated that an additive such as for example cerium (III, IV) compounds may be used as a catalyst for the process.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined with any one of the aspects and remain within the scope of the invention. Accordingly, the present invention is not to be restricted except in light of the attached claims and their equivalents.

What is claimed is:

1. A material removal method, comprising:

receiving a component that includes a component body and a coating on the component body, the component body comprising metallic first material, and the coating comprising a second material that is different from the first material, wherein the component is a component of an item of rotational equipment;

mixing a solution comprising nitric acid, hydrogen peroxide, and water in an atmosphere of supercritical carbon dioxide and introducing at least one of a cerium (III) compound or a cerium (IV) compound to the solution; and subjecting at least a portion of the coating to the solution in a supercritical condition in order to remove at least some of the second material from the component, wherein a chemistry of the solution is selected such that the solution is substantially non-reactive with the first material.

2. The method of claim 1, wherein the solution comprises between about 1 to 40 percent by volume of the nitric acid.

3. The method of claim 1, wherein the solution comprises between about 1 to 25 percent by volume of the hydrogen peroxide.

4. The method of claim 1, wherein the solution comprises one or more complexing agents.

5. The method of claim 4, wherein the one or more complexing agents comprises at least one of ammonia, organic amine, organic acids, inorganic acids, and/or halide.

6. The method of claim 1, wherein the second material comprises a byproduct of corrosion of the first material.

7. The method of claim 1, further comprising maintaining the solution at a temperature between about 30 to 90 degrees Celsius during the subjecting of at least a portion of the coating to the solution in supercritical condition.

8. The method of claim 1, wherein at least a portion of the coating is subjected to the solution in supercritical condition for a time period between about 0.5 to 4 hours.

9. The method of claim 1, wherein at least a portion of the coating is at an internal surface of the component.

10. The method of claim 1, wherein the item of rotational equipment comprises a gas turbine engine, and the component comprises an airfoil.

11. The method of claim 1, wherein the item of rotational equipment is a gas turbine engine.

12. A material removal method, comprising:

receiving a component that includes a component body and a coating on the component body, the component body comprising metallic first material, and the coating comprising a second material that is different from the first material, wherein the component is a component of a gas turbine engine;

mixing a solution comprising nitric acid, hydrogen peroxide, and water in an atmosphere of supercritical carbon dioxide and introducing at least one of a cerium (III) compound or a cerium (IV) compound to the solution; and subjecting, within an autoclave, at least a portion of the coating to the solution in a supercritical condition in order to remove at least some of the second material from the component;

wherein the second material comprises scales of nitride, oxides, salt and/or sulfide.

13. The method of claim 12, wherein the first material comprises a nickel alloy.

14. The method of claim 12, wherein the first material comprises a cobalt alloy.

15. The method of claim 12, wherein the first material comprises a single crystal microstructure.

16. A material removal method, comprising:

receiving a component of a gas turbine engine, the component including a component body and a coating on the component body, the component body comprising a nickel and/or cobalt alloy, and the coating comprising material that is a byproduct of corrosion of the component body;

mixing a solution comprising nitric acid, hydrogen peroxide, and water in an atmosphere of supercritical carbon dioxide and introducing at least one of a cerium (III) compound or a cerium (IV) compound to the solution; and within an autoclave subjecting the coating at a location on the component body to the solution in a supercritical condition in order to remove all of the material at the location on the component body from the component by dissolving the material at the location on the component body with the solution in a steady digestive process.

17. The method of claim 16, wherein the component comprises an airfoil for the turbine engine.

18. The method of claim 16 wherein the solution comprises between about 1 to 40 percent by volume of the nitric acid and between about 1 to 25 percent by volume of the hydrogen peroxide.

19. The method of claim 16, further comprising:

maintaining the solution at a temperature between about 30 to 90 degrees Celsius and a pressure of about 80 to 200 atm during the subjecting of coating at the location on the component body to the solution in supercritical condition;

wherein the coating at the location on the component body is subjected to the solution in supercritical condition for a time period between about 0.5 to 4 hours.

20. The method of claim 16, further comprising:

maintaining the solution at a temperature between about 50 to 90 degrees Celsius and pressure of about 80 to 100 atm during the subjecting of the coating at the location on the component body to the solution in supercritical condition;

wherein the coating at the location on the component body is subjected to the solution in supercritical condition for a time period between about 0.5 to 4 hours.

* * * * *